US007775258B2

(12) United States Patent
Yashiro et al.

(10) Patent No.: US 7,775,258 B2
(45) Date of Patent: Aug. 17, 2010

(54) METHOD AND APPARATUS FOR REMOVING A CASTED PART FOR USE IN A DIE CASTING MACHINE

(75) Inventors: Masaki Yashiro, Ebina (JP); Hiroshi Yokoyama, Ebina (JP)

(73) Assignee: Toshiba Kikai Kabushiki Kaisha, Tokyo-To (JP)

( * ) Notice: Subject to any disclaimer, the term of this patent is extended or adjusted under 35 U.S.C. 154(b) by 0 days.

(21) Appl. No.: 11/615,095

(22) Filed: Dec. 22, 2006

(65) Prior Publication Data

US 2007/0181279 A1 Aug. 9, 2007

(30) Foreign Application Priority Data

Dec. 26, 2005 (JP) ..... 2005-371579

(51) Int. Cl.
*B22D 17/32* (2006.01)
*B22D 29/00* (2006.01)

(52) U.S. Cl. ..... 164/312; 164/131; 164/347

(58) Field of Classification Search ..... 164/131–132, 164/113, 312, 345–347; 425/139, 444, 556
See application file for complete search history.

(56) References Cited

U.S. PATENT DOCUMENTS 6,485,285 B1 * 11/2002 Shiotani ..... 425/139
6,669,877 B2 * 12/2003 Matsubayashi et al. .... 264/40.1

FOREIGN PATENT DOCUMENTS

| | | | |
|---|---|---|---|
| JP | 62-170312 | * | 7/1987 |
| JP | 06-71411 | | 3/1994 |
| JP | 06-071411 | * | 3/1994 |

* cited by examiner

*Primary Examiner*—Kuang Lin
(74) *Attorney, Agent, or Firm*—DLA Piper LLP US

(57) ABSTRACT

A method for removing a casted part, for use in a die casting machine comprises the steps of setting a position in which a chuck performs an operation to grasp a casted part attached to a movable mold as a position from which the casted part is to be removed, and setting a relative positional relationship between a handle portion which is a part of the casted part attached to the movable mold to be grasped by the chuck and a movable die plate. The method further comprises the step of advancing the chuck between the movable mold and the fixed mold and positioning the chuck at the position from which the casted part is to be removed, in parallel with the movement of the movable die plate. Additionally, the method comprises the steps of stopping the movable die plate when the handle portion of the casted part attached to the movable mold reaches the position from which the casted part is to be removed, grasping the handle portion of the casted part by using the chuck, and removing the casted part from the movable mold.

11 Claims, 3 Drawing Sheets

METHOD AND APPARATUS FOR REMOVING A CASTED PART FOR USE IN A DIE CASTING MACHINE

BACKGROUND OF THE INVENTION

1. Field of the Invention

The present invention relates to a method and an apparatus for removing a casted part for use in a die casting machine, and in particular to a method and an apparatus for removing a casted part for use in a die casting machine utilizing an electric clamping machine which is driven by a servomotor such that a movable die plate can be stopped and positioned in any desired position along the mold opening/closing direction.

2. Background Art

In a conventional die casting machine, in order to remove a casted part from a mold, a casted part-removing apparatus is installed on a fixed die plate, a movable die plate or floor of the machine as disclosed in Japanese Patent Laid-Open No. 6-71411. After injecting a melt material into a mold cavity, the removal of a casted part is performed as described below.

First, the movable die plate is moved to a position that is an opening limit point of the mold. In this position, a chuck of a casted part-removing apparatus is advanced between a movable mold and a fixed mold. The chuck is generally configured to grasp a biscuit portion, as a handle, of a casted part attached to the movable mold. Then, the chuck is removed out of the mold while grasping the casted part attached to the movable mold.

The biscuit portion of the casted part to be grasped by the chuck varies in position depending on the mold to be used. Namely, depending on the thickness of the mold and the shape of the casted part, the distance from a mold-attaching face of the movable die plate to the biscuit portion varies. Therefore, in either case where a casted part-removing apparatus is installed on the fixed die plate, movable die plate or floor, a waiting position of the chuck of the casted part-removing apparatus, i.e., the position of a start point of a route along which the chuck is advanced toward the biscuit portion of the casted part must be set and changed corresponding to the position of the biscuit portion every time the mold to be used is changed.

In place of setting and changing the waiting position of the chuck of the casted part-removing apparatus, there is a method of adding an operation such that the chuck is moved also in the mold opening/closing direction corresponding to the biscuit position of the casted part every time the casted part is removed. In either case, such a casted part-removing apparatus in the conventional die casting machine may tend to render setting and changing and/or removing operation upon change of the mold complicated.

Therefore, it is an object of the present invention to provide a method and an apparatus for removing a casted part from a die casting machine, which can overcome the problems as described above in the prior art, and which is for use in a die casting machine utilizing an electric clamping machine driven by a servomotor such that the movable die plate can be stopped and positioned in any desired position along the mold opening/closing direction, and which can perform a step of removing a casted part by utilizing a servomechanism of the clamping machine with ease and efficiency.

SUMMARY OF THE INVENTION

To achieve the object described above, the present invention provides a method for removing a casted part, for use in a die casting machine which includes a fixed die plate, a movable die plate, a mold composed of a fixed mold attached to the fixed die plate and a movable mold attached to the movable die plate, an electric clamping machine configured such that a mold opening/closing mechanism adapted to move the movable die plate is driven by a servomotor, and a casted part removing means including a chuck adapted to grasp a casted part attached to the movable mold after the mold opening operation and a chuck driving mechanism adapted to move the chuck from a waiting position at the exterior of the mold to any desired position between the fixed mold and the movable mold, the method comprising the steps of: installing the casted part removing means at the fixed die plate; setting a position in which the chuck performs an operation to grasp the casted part attached to the movable mold as a position from which the casted part is to be removed; setting a relative positional relationship between a handle portion which is a part of the casted part attached to the movable mold to be grasped by the chuck and a movable die plate; advancing the chuck between the movable mold and the fixed mold, and positioning the chuck at the position from which the casted part is to be removed, in parallel with the movement of the movable die plate; stopping the movable die plate when the handle portion of the casted part attached to the movable mold reaches the position from which the casted part is to be removed, in the middle of the driving stroke of the movable die plate; grasping the handle portion of the casted part by using the chuck, and removing the casted part from the movable mold; and moving the movable die plate in the mold opening direction, and having the chuck grasping the casted part wait at the waiting position, in parallel with the step of moving the movable die plate.

The present invention also provides a casted-part removing apparatus for use in a die casting machine, which includes a fixed die plate, a movable die plate, a mold having a fixed mold attached to the fixed die plate and a movable mold attached to the movable die plate, and an electric clamping machine configured such that a mold opening/closing mechanism adapted to move the movable die plate is driven by a servomotor, the casted-part removing apparatus comprising: a casted part removing device including a chuck adapted to grasp or take hold of the casted part attached to the movable mold when the mold is opened after a casting operation, and a chuck driving mechanism adapted to move the chuck from a fixed standby position in a space outside of the mold to an expected position in a space between the fixed mold and the movable mold; a pushing/driving device adapted to drive pushing pins for pushing out the casted part from the movable mold; a control device configured to set the expected position at which the chuck takes hold of the casted part attached to the movable mold, the expected position being a combination of a position of the movable die plate and a relative position between a portion of the casted part attached to the movable mold to be taken hold of by the chuck and the movable die plate; and a servo-control device configured to stop the movable die plate during a mold opening operation at a desired position so that the portion of the casted part to be taken hold of by the chuck reaches the expected position at which the casted part is to be removed.

DETAILED DESCRIPTION OF THE INVENTION

Examples

Hereinafter, one embodiment of a method and an apparatus for removing a casted part for use in a die casting machine according to the present invention will be described with reference to the attached drawings.

Figure 1:
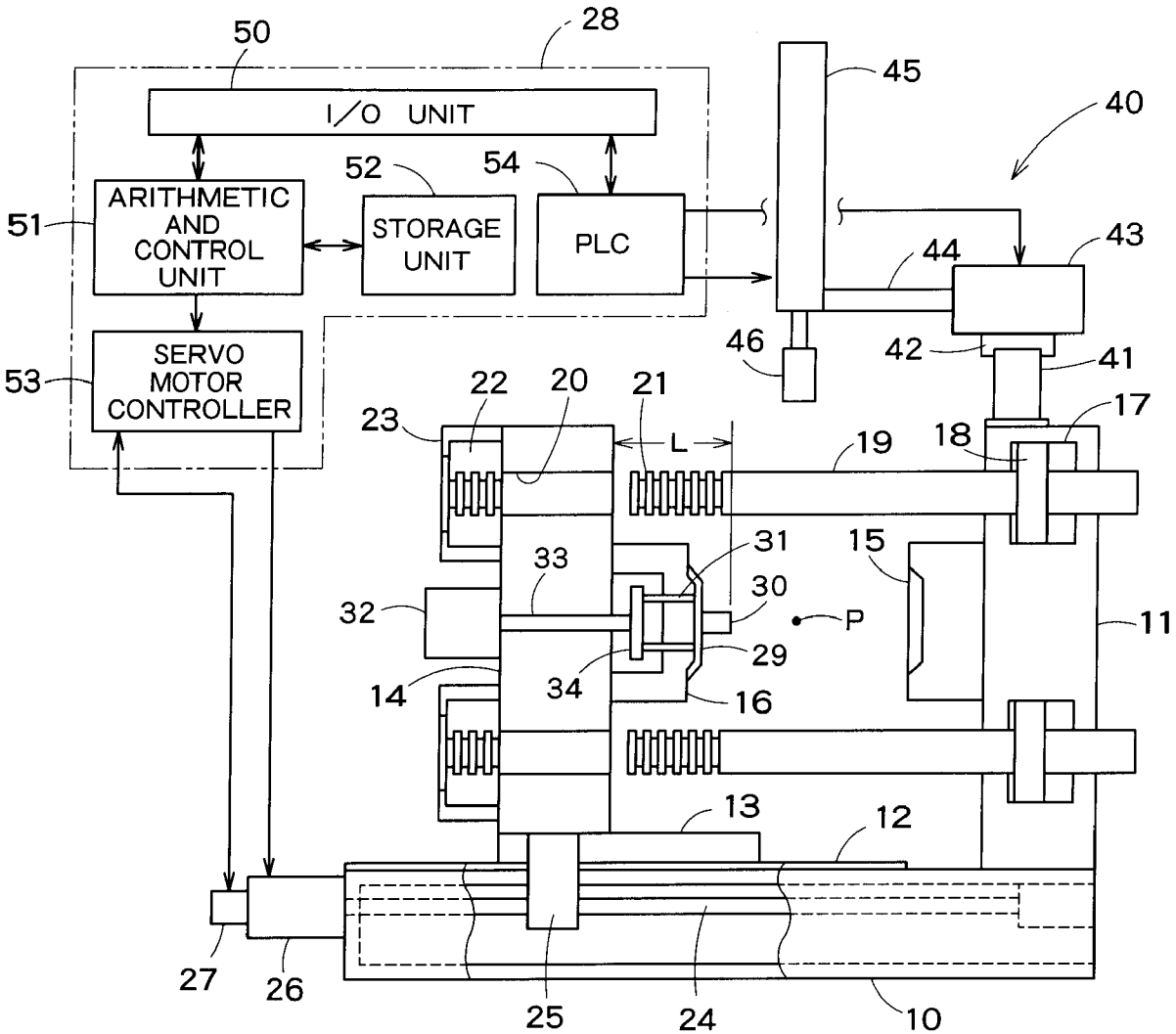
FIG. 1 is a schematic diagram of a casted part-removing apparatus for use in a die casting machine according to one embodiment of the present invention.

In FIG. 1, reference numeral 10 denotes a base. A fixed die plate 11 is attached and fixed to a right end, as shown in FIG. 1, of the base 10. On the top face of the base 10, two guides are respectively provided in parallel to each other at front and back sides when viewed in FIG. 1, and the two guides extend in the lateral direction in FIG. 1. Sliders 13 are slidably engaged with these guides 12, respectively. Each slider 13 is fixed at a lower portion of a movable die plate 14.

The fixed die plate 11 and the movable die plate 14 are arranged opposite to each other, a fixed mold 15 and a movable mold 16 constituting a pair of components of one mold are attached to the respective die plates. Clamping cylinders 17 are provided at four corners of the fixed die plate 11, respectively. In FIG. 1, the left to right direction or lateral direction expresses the clamping or mold opening/closing direction (hereinafter, referred to as the mold opening/closing direction) in which the movable die plate 14 is moved along the guide 12. Each clamping cylinder 17 includes a clamping piston 18. A piston rod 19 extends from each clamping piston 18 toward the movable die plate 14 along the mold opening/closing direction and constitutes the so-called tie bar for use in clamping (hereinafter, the piston rod 19 is referred to as the tie bar 19).

At the four corners of the movable die plate 14, through-holes 20 are provided for movably receiving the tie bars 19, respectively. A plurality of ring-shaped grooves (or spiral threads) 21 are formed at an equal interval at a distal portion of each tie bar 19. Half nuts 22 are provided at the back face of the movable die plate 14, each of which can be engaged with the corresponding grooves 21. The half nuts 22 are divided in two to form a pair of partial nuts and configured to open and close in the vertical direction when viewed in FIG. 1 along a guide 23 due to a driving machine (not shown).

Next, a mold opening/closing mechanism for driving the movable die plate 14 will be described. A feeding ball screw 24 is attached to the base 10, which extends in parallel to the mold opening/closing direction. A feeding nut 25 attached to the movable die plate 14 is engaged with the feeding ball screw 24. The feeding ball screw 24 is driven by a servomotor 26 provided with an encoder 27 and is configured to move the movable die plate 14 along the mold opening/closing direction by a predetermined amount and at a predetermined speed due to a servomechanism provided to a control unit 28 so as to position the movable plate at any desired point.

Thus, because the mold opening/closing mechanism is driven by the servomotor 26, a significantly larger amount of movement of the movable die plate 14, can be achieved. That is, the movement in a stroke can correspond to the distance from an opening limit position of the movable mold 16 to a closing limit position of the movable mold 16. In a mold closing position, the movable mold 16 is stopped in a state where the movable mold 16 is in a position near to the fixed mold 15. The clamping machine of this embodiment is a so-called composite type electric clamping machine, in which clamping of the movable mold 16 and fixed mold 15 is performed by pulling the tie bars 19 using the clamping cylinders 17 and having each half nut 22 being engaged with the corresponding grooves of the associated tie bar 19.

Reference numeral 30 denotes a biscuit portion used as a handle portion, which is formed integrally with a casted part 29 and is adapted for removing the casted part 29. In the drawing, reference numeral 31 denotes a pushing rod which serves to push out the casted part 29 closely attached to the movable mold 16. Each pushing rod 31 projects a predetermined distance at a predetermined speed via a pushing member 33 and a pushing plate 34 due to a pushing/driving unit 32 such as a cylinder.

Next, a casted part-removing device adapted to remove a casted part molded by a die casting machine will be described.

In this embodiment, a chuck driving mechanism 40 for driving a chuck 46 adapted to grasp or take hold of the casted part 29 is provided at the fixed die plate 11. The chuck driving mechanism 40 is a vertically-driving type mechanism adapted to drive the chuck 46 in two orthogonal directions.

At an upper portion of the fixed die plate 11, a rail 41 is attached to extend in a direction vertical to the paper of FIG. 1, and a slider 42 that is attached to a chuck horizontally driving unit 43 is slidably engaged with the rail 41. The chuck horizontally driving unit 43 incorporates an actuator (not shown) capable of driving a horizontal bar 44 a predetermined distance in the mold opening/closing direction. At a distal end of the horizontal bar 44 a chuck vertically driving unit 45 is supported. The chuck vertically driving unit 45 is composed of an actuator (not shown), such as a cylinder, which is adapted to raise and lower the chuck 46 between a waiting position shown in FIG. 1 and a position for grasping the biscuit portion 30. The chuck horizontally driving unit 43 is configured to move the chuck 46 in the mold closing direction, together with the pushing/driving unit 32 adapted to actuate the pushing rods 31, while the biscuit portion 30 of the casted part 29 is grasped by the chuck 46.

Next, the control unit 28 will be described with reference to FIG. 1. The control unit 28 includes, as typical components, an input/output unit 50, an operational control unit 51, a memory 52, a servomotor control unit 53, and a Programmable Logic Controller (PLC) 54.

In FIG. 1, the expected position P from which the casted part 29 is to be removed is set at a position in which the biscuit portion 30 of the casted part 29 attached to the movable mold 16 will exist upon removing the casted part 29 from the mold. Also, the expected position P is a position at which the chuck 46 performs an operation to grasp the biscuit portion 30 of the casted part 29. The distance L designates a distance from the face, to which the mold is attached, of the movable die plate 14 to the biscuit portion 30.

The expected position P from which the casted part is to be removed is an absolute position that is not changed and set at an intermediate position of the stroke in which the movable mold 16 is moved between the mold closing position and the mold opening position even if the casted part to be cast is changed due to exchange of molds. Thus, once the expected position P is set on the axes of coordinates in the machine, it is not changed even if the mold is exchanged.

Contrary, the distance L defined from the face, to which the mold is attached, of the movable die plate 14 to the biscuit portion 30 is a value which varies with the thickness of the mold and/or the shape of the casted part. While the distance L is kept constant as long as the same casted part is cast by the same mold, the distance L should be set anew if the molds are exchanged.

The data concerning the expected position P and distance L are inputted to the operational control unit 51 via the input/ output unit 50 from an input unit (not shown) and then stored in the memory 52. The operational control unit 51 can recognize the relative positional relationship between the biscuit portion 30 and the movable die plate 14 based on the distance L from the face, to which the mold is attached, of the movable die plate 14 to the biscuit portion 30. Then, the operational control unit 51 calculates a position of the movable die plate 14 at the time the position of the biscuit portion 30 of the casted part 29 attached to the movable mold 16 will coincide with the expected position P from which the casted part is to be removed.

When the step of removing the casted part is started, the operational control unit 51 instructs the servomotor control unit 53 that the position calculated as described above is a target position of movement. As a result, the servomotor control unit 53 controls the servomotor 26 so as to position the movable die plate 14 at the target position while obtaining feed back concerning the current position of the movable die plate 14 from the encoder 27 and comparing it with the target position. In this way, the biscuit portion 30 of the casted part 29 is positioned at the expected position P from which the casted part is to be removed.

The PLC 54 is connected with the operational control unit 51. The PLC 54 controls the operation of the casted part-removing apparatus in accordance with a sequence shown in FIG. 3. Namely, the horizontal bar 44 is advanced or retracted by actuating the chuck horizontally driving unit 43, and a vertical bar 35 is driven in the vertical direction by actuating the chuck vertically driving unit 45. In this way, as will be described below, the chuck 46 can be moved along a predetermined route between the waiting position shown in FIG. 1 and the expected position P from which the casted part is to be removed.

Figure 3:
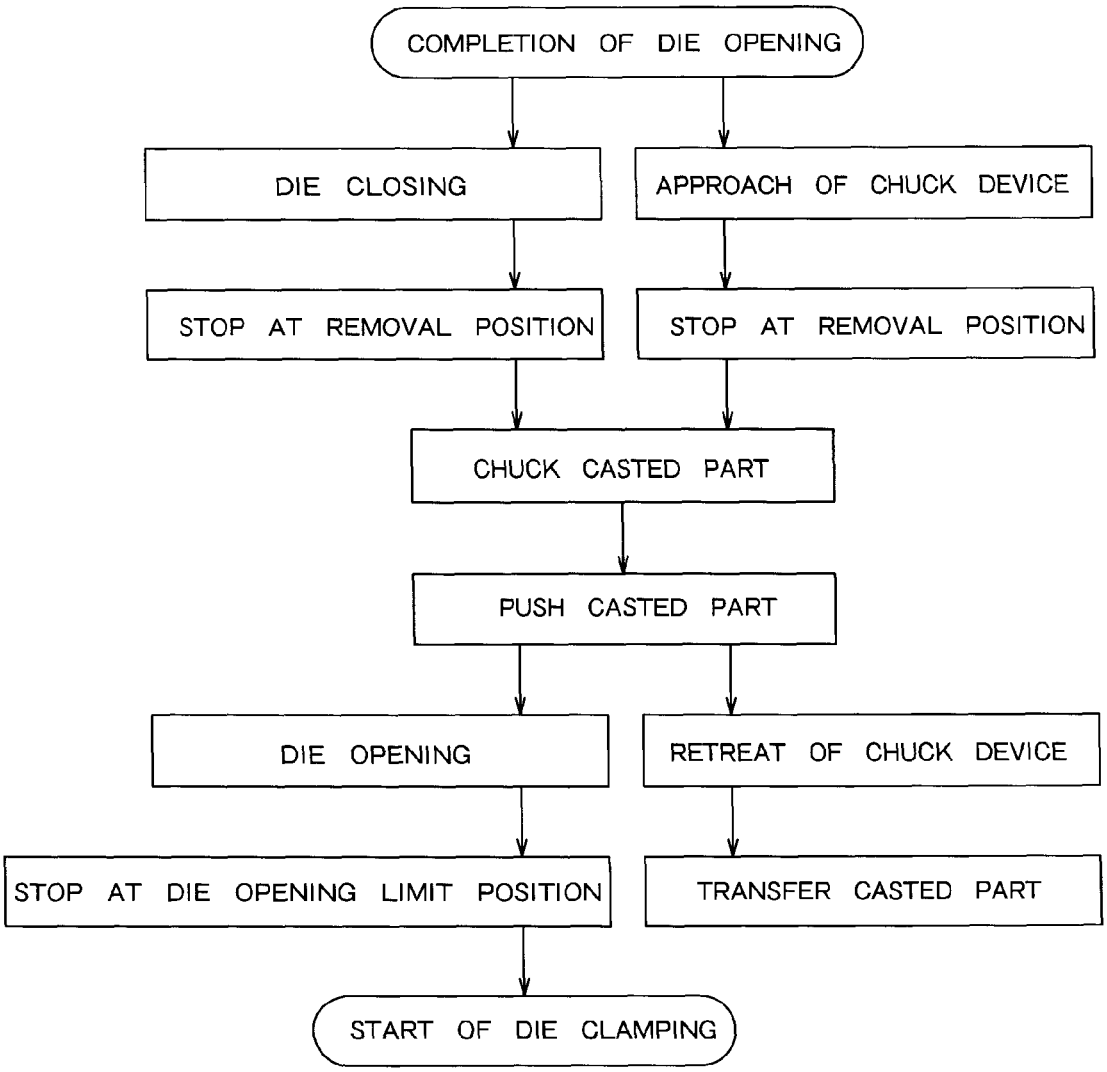
FIG. 3 is a flow chart showing a sequence of an operation for removing a casted part according to the present invention.

Next, the operation of the casted part-removing apparatus according to the present invention will be described in connection with proceeding of the step of removing the casted part with reference to the sequence of FIG. 3, As described above, when the fixed mold 15 and the movable mold 16 are exchanged with new ones, the distance L defined from the face, to which the mold is attached, of the movable die plate 14 to the biscuit portion 30 is also changed. Thus, the distance L should be set anew by inputting a value of the new distance L into the control unit 28.

Prior to start of a molding cycle utilizing the new fixed mold 15 and movable mold 16, the standby or waiting position of the chuck 46 is adjusted. In this embodiment, the standby or waiting position is set just above the expected position P from which the casted part is to be removed, by moving the horizontal bar 44. Thereafter, the standby or waiting position of the chuck 46 is fixed as long as the casting process is not changed.

Figure 2:
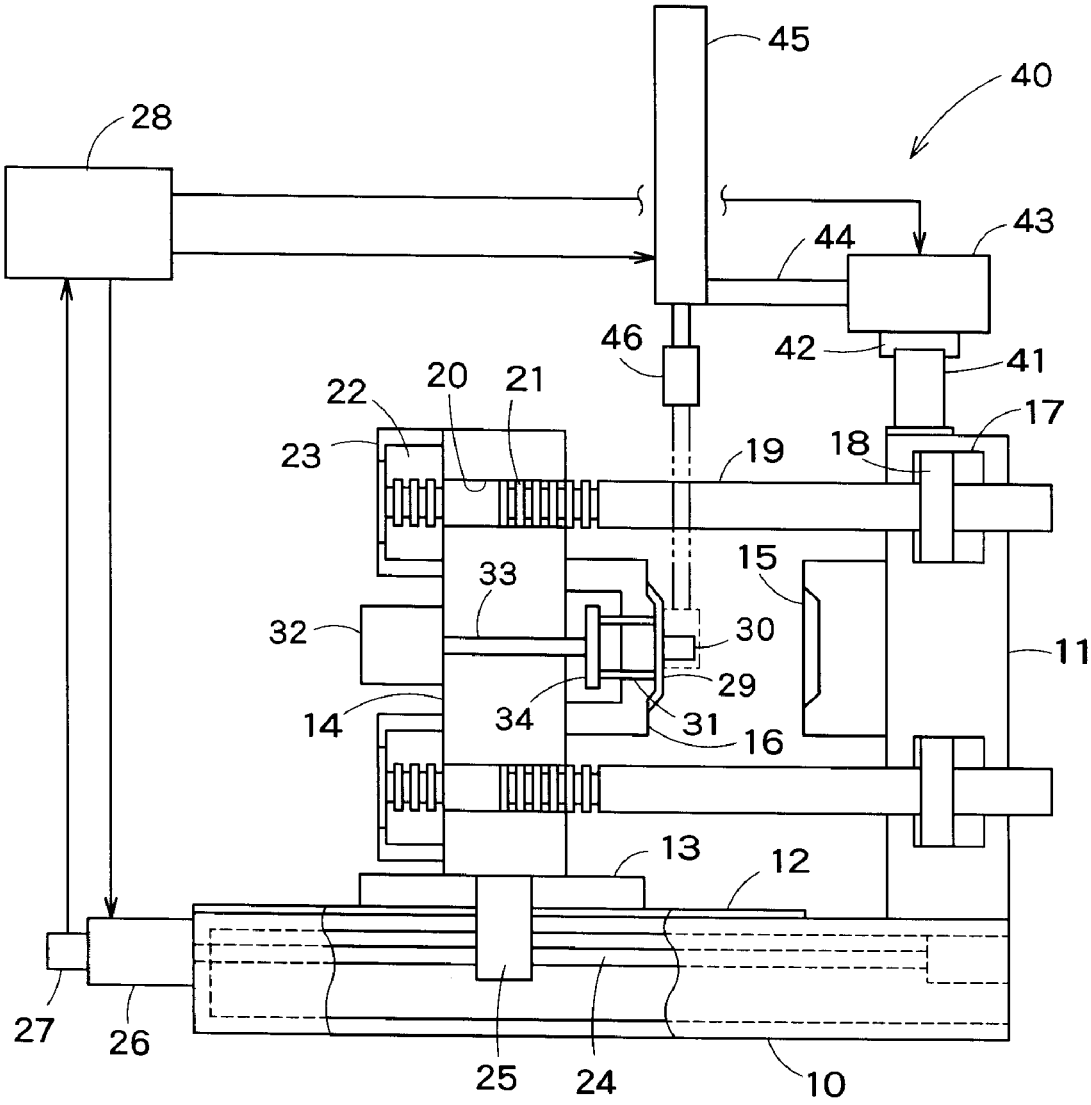
FIG. 2 is a schematic diagram showing movement of a movable die plate in the mold closing direction and an advancing operation of a chuck.

When the casting cycle is started, the movable die plate 14 is moved in the mold closing direction until the movable mold 16 abuts the fixed mold 15. Then, the clamping cylinder 17 is operated to perform clamping. After injecting and filling a melt casting material in the mold cavity, as shown in FIG. 2, the movable die plate 14 is moved up to an opening limit point of the mold so as to open the mold.

Upon completion of the mold opening step, at a proper timing, an instruction for starting the casted part-removing step is transmitted from a control board of the die casting machine to the control unit 28. Then, in the order shown in FIG. 3, the casted part-removing operation of the chuck 46 and the movement of the movable die plate 14 will be coordinated.

Upon receiving the instruction for start, the PLC 54 sends a signal for activating the servomotor 26 to the servomotor control unit 53 so as to start movement in the mold closing direction of the movable die plate 14. During this movement of the movable die plate 14, the position of the movable die plate 14 detected by the encoder 27 is fed back to the servomotor control unit 53. When the movable die plate 14 is moved to the position shown in FIG. 3 or when the biscuit portion 30 of the casted part 29 attached to the movable mold 16 reaches the expected position P from which the casted part is to be removed, the movable die plate 14 is stopped. Thus, the biscuit portion 30 is positioned accurately at the expected position P from which the casted part is to be removed.

Concurrently with the movement of the movable die plate 14, the PLC 54 actuates the chuck vertically driving unit 45 to lower the chuck 46. Then, the chuck 46 is advanced between the movable mold 16 and fixed mold 15 toward the expected position P from which the casted part is to be removed. In this way, the chuck 46 is lowered up to the expected position P over a minimum distance straightly from the standby or waiting position and stopped at the expected position P.

In this way, when the biscuit portion 30 of the casted part 29 and the chuck 46 are respectively positioned at the expected position P from which the casted part is to be removed, the chuck 46 is actuated to grasp the biscuit portion 30.

Once the taking hold of the biscuit portion 30 by the chuck 46 is completed, the PLC 54 actuates the pushing/driving unit 32 and the chuck horizontally driving unit 43 to be in cooperation with each other. As a result, each pushing rod 31 projects in the mold closing direction to push out the casted part 29 from the movable mold 16. At the same time, the chuck 46 is moved in the mold closing direction synchronously with the pushing rods 31 so as to remove the casted part 29 from the movable mold 16 in the mold closing direction.

Upon the end of the removing operation, the PLC 54 actuates the servomotor 26 again to start the mold opening operation in which the movable die plate 14 is moved to the mold opening limit point. In parallel with the operation, the chuck vertically driving unit 45 is actuated such that the chuck 46 is raised while grasping the casted part 29. In this way, the casted part 29 can be removed from a space between the fixed mold 15 and the movable mold 16.

When the movable die plate 14 is moved to the mold opening limit point, a clamping operation which is the first step of a next casting cycle is started. On the other hand, the whole body of the chuck driving mechanism 40 is moved along the rail 41 while grasping the casted part 29 by using the chuck 46. After carrying the casted part 29 to a predetermined place which is an exterior of the machine, the chuck 46 returns to the waiting position. At this time, the casted part removing operation is ended.

As described above, according to the present invention, the biscuit portion 30 of the casted part 29 is moved to the expected position P from which the casted part 29 is to be removed and which has been already set as an absolute position, whereby the biscuit portion 30 can be positioned accurately at the expected position P by utilizing the servomechanism of the electric clamping machine. Thus, even in the case where the mold is changed, it is not necessary to change the waiting position of the chuck 46 as well as to adjust its driving route on the side of the chuck driving mechanism 40 according to the position of the biscuit 30.

The chuck 46 can grasp the casted part 29 by advancing it only a predetermined minimum distance between the movable mold 16 and the fixed mold 15 from the waiting position. As such, the advancing and removing operations of the chuck 46 become simple, and the operation to move the movable die plate 14 in the mold closing direction can be performed in parallel with the advancing operation of the chuck 46, thereby enhancing efficiency of the casted part removing step as well as reducing the cycle time of the casting step.

In the embodiment described above, an example in which the casted part 29 is removed, at the point of time the mold opening operation is completed after injecting and filling a melt casting material into the mold cavity in the molding operation, by moving the movable die plate 14 and the chuck 46 at the same time has been disclosed. However, the present invention is not limited to this aspect. For example, the biscuit portion 30 may be positioned at the expected position P from which the casted part is to be removed during the mold opening operation after injecting and filling a melt casting material into the mold cavity in the molding operation as well as the chuck 46 may be advanced to the expected position P in parallel with the mold opening operation.

In the embodiment described above, an example in which the casted part 29 is pushed out from the movable mold 16 by the pushing/driving unit 32 after the chuck 46 grasps the biscuit portion 30 as well as the chuck 46 is moved in the mold closing direction in synchronism with the pushing out operation has been disclosed. However, the present invention is not limited to this aspect. For example, the pushing out operation may be performed before the chuck 46 grasps the biscuit portion 30 so that the biscuit portion 30 having been pushed out up to the position from which the casted part is to be removed can be grasped by the chuck 46 waiting at the position.

Furthermore, in the embodiment described above, while an example in which the chuck driving mechanism 40 constituting a casted part removing apparatus is provided at the fixed die plate 11 has been disclosed, a similar effect can also be obtained if the chuck driving mechanism 40 is provided at a proper portion on the side of the fixed die plate 11, including the base 10 or on the floor on which the base 10 is installed.

Additionally, in the embodiment described above, an example using the so-called composite type electric clamping machine, as an electric clamping machine utilizing a servomotor, in which the mold opening/closing operation is performed by using the servomotor 26 and the feeding ball screw 24 while the clamping operation is performed by the clamping cylinder 17 has been disclosed. However, the present invention is not limited to this aspect. This invention can be applied to various die casting machines utilizing an electric clamping machine which can be positioned and/or stopped at any given point, such as a toggle type clamping machine in which a toggle link mechanism is driven by a servomotor.

The invention claimed is:

1. A casted-part removing apparatus for use in a die casting machine, which includes a fixed die plate, a movable die plate, a mold having a fixed mold attached to the fixed die plate and a movable mold attached to the movable die plate, and an electric clamping machine having a mechanism driven by a servomotor and configured to move the movable die plate, the casted-part removing apparatus comprising:

a removing device including a chuck configured to take hold of a casted part attached to the movable mold when the mold is opened after a casting operation, and a chuck driving mechanism configured to move the chuck from a fixed standby position in a space outside the mold to an expected position at which the chuck takes hold of the casted part between the fixed mold and the movable mold, the expected position being the same position for any given mold from a plurality of molds used with the casted-part removing apparatus and each mold from the plurality of molds being configured to produce a casted part different from a casted part produced by another mold from the plurality of molds;

a driving device configured to drive pushing pins that push out the casted part from the movable mold;

a control device constructed and arranged to set a distance between a portion of the casted part to be taken hold of by the chuck and the movable die plate, and to calculate a target position of the movable die plate based on the set distance so that the position of the portion of the casted part to be taken hold of by the chuck coincides with the expected position; and a servo-control device constructed and arranged to control the servomotor to stop the movable die plate during a mold opening operation at the target position so that the portion of the casted part to be taken hold of by the chuck reaches the expected position from which the casted part is to be removed.

2. The casted-part removing apparatus for use in a die casting machine according to claim 1, further comprising:

a sequence control device configured to control a sequence in accordance with a predetermined order, the sequence including an operation to move the movable mold, an operation to have the chuck start move from the fixed standby waiting position into the space between the movable mold and the fixed mold concurrently with the operation to move the movable mold, an operation to position the chuck at the expected position at which the casted part is to be removed, an operation to stop movement of the movable mold and position the movable mold at the stopped position when the portion of the casted part reaches the expected position from which the casted part is to be removed, an operation to take hold of the casted part by using the chuck, an operation to push out the casted part attached to the movable mold by using the pushing pins, and an operation to have the chuck taking hold of the casted part wait at the fixed standby position.

3. The casted-part removing apparatus for use in a die casting machine according to claim 1, wherein:

the chuck driving mechanism includes an orthogonal type driving mechanism having a horizontal driving apparatus configured to move the chuck in the direction parallel to a driving direction of the movable die plate, and an vertical driving apparatus configured to move the chuck in a direction perpendicular to the driving direction of the movable die plate.

4. The casted-part removing apparatus for use in a die casting machine according to claim 3, wherein:

the horizontal driving apparatus is configured to allow the chuck taking hold of the casted part to move in a mold closing direction concurrently with the pushing pins pushing out the casted part.

5. The casted-part removing apparatus for use in a die casting machine according to claim 2, wherein:

the sequence control device is configured to have the movable die plate start to move in a mold closing direction of the movable die plate concurrently with the start of the chuck moving toward the space between the movable mold and the fixed mold, when the movable die plate is in a mold opening limit position.

6. The casted-part removing apparatus for use in a die casting machine according to claim 2, wherein:

the sequence control device is configured to have the chuck start moving toward the space between the movable mold and the fixed mold concurrently with the mold opening operation of the movable die plate, after the filling of a melt casting material into the mold cavity.

7. The casted part-removing apparatus for use in a die casting machine according to claim 1, wherein:

the electric clamping machine is a composite type clamping machine which includes a feeding ball screw mechanism configured to be driven by a servomotor and clamping cylinder configured to generate a clamping force to close the fixed mold, and the servo-control device is configured to control the servomotor for driving the feeding ball screw mechanism.

8. An apparatus for use in a die casting machine including a base, a guide disposed on the base, a fixed die plate, a movable die plate, a mold having a fixed portion coupled to the fixed die plate and a movable portion coupled to the movable die plate, and a mechanism driven by a servomotor and configured to move the movable die plate along the guide, the apparatus comprising:

a chuck configured to take hold of a casted part attached to the movable portion of the mold;

a chuck driving mechanism having a first device configured to move the chuck in a direction substantially parallel to the guide and a second device configured to move the chuck in a direction substantially perpendicular to the guide;

a first controller constructed and arranged to control the chuck driving mechanism such that the chuck moves from a fixed standby location to a predetermined location at which the chuck takes hold of the casted part between the fixed portion of the mold and the movable portion of the mold, the predetermined location being the same location for any given mold from a plurality of molds used with the apparatus and each mold from the plurality of molds being configured to produce a casted part different from a casted part produced by another mold from the plurality of molds;

a second controller constructed and arranged to control the servomotor such that the movable die plate having the movable portion of the mold to which the casted part is attached moves to a target position along the guide so that the position of a portion of the casted part to be taken hold of by the chuck coincides with the predetermined location, the first controller and the second controller configured to respectively move the chuck and the portion of the casted part to be taken hold of by the chuck to the predetermined location concurrently; and a third controller constructed and arranged to determine the target position along the guide where the movable die plate is moved, the target position along the guide being a relative position to the predetermined location and based on the shape of the mold, or the thickness of the mold, or both.

9. The apparatus of claim 8, further comprising:

a driving device configured to drive pushing pins that push out the casted part from the movable portion of the mold.

10. A casted-part removing apparatus for use in a die casting machine, which includes a fixed die plate, a movable die plate, a mold having a fixed mold attached to the fixed die plate and a movable mold attached to the movable die plate, and an electric clamping machine having a mechanism driven by a servomotor and configured to move the movable die plate, the casted-part removing apparatus comprising:

a removing device including a chuck configured to take hold of a casted part attached to the movable mold when the mold is opened after a casting operation, and a chuck driving mechanism configured to move the chuck from a fixed standby position in a space outside the mold to an expected position at which the chuck takes hold of the casted part between the fixed mold and the movable mold, the expected position being the same position for any given mold from a plurality of molds used with the casted-part removing apparatus and each mold from the plurality of molds being configured to produce a casted part different from a casted part produced by another mold from the plurality of molds;

a driving device configured to drive pushing pins that push out the casted part from the movable mold;

a control device configured to set a distance between a portion of the casted part to be taken hold of by the chuck and the movable die plate, and to calculate a target position of the movable die plate based on the set distance so that the position of the portion of the casted part to be taken hold of by the chuck coincides with the expected position; and means for controlling the servmotor to stop the movable die plate during a mold opening operation at the target position so that the portion of the casted part to be taken hold of by the chuck reaches the expected position from which the casted part is to be removed.

11. An apparatus for use in a die casting machine including a base, a guide disposed on the base, a fixed die plate, a movable die plate, a mold having a fixed portion coupled to the fixed die plate and a movable portion coupled to the movable die plate, and a mechanism driven by a servomotor and configured to move the movable die plate along the guide, the apparatus comprising:

a chuck configured to take hold of a casted part attached to the movable portion of the mold;

a chuck driving mechanism having a first device configured to move the chuck in a direction substantially parallel to the guide and a second device configured to move the chuck in a direction substantially perpendicular to the guide;

a first controller configured to control the chuck driving mechanism such that the chuck moves from a fixed standby location to a predetermined location at which the chuck takes hold of the casted part between the fixed portion of the mold and the movable portion of the mold, the predetermined location being the same location for any given mold from a plurality of molds used with the apparatus and each mold from the plurality of molds being configured to produce a casted part different from a casted part produced by another mold from the plurality of molds;

a second controller including means for controlling the servomotor such that the movable die plate having the movable portion of the mold to which the casted part is attached moves to a target position along the guide so that the position of a portion of the casted part to be taken hold of by the chuck coincides with the predetermined location, the first controller and the second controller configured to respectively move the chuck and the portion of the casted part to be taken hold of by the chuck to the predetermined location concurrently; and a third controller configured to determine the target position along the guide where the movable die plate is moved, the target position along the guide being a relative position to the predetermined location and based on the shape of the mold, or the thickness of the mold, or both.

* * * * *